US009521909B2

(12) United States Patent
Li et al.

(10) Patent No.: US 9,521,909 B2
(45) Date of Patent: Dec. 20, 2016

(54) RAPIDLY ASSEMBLED SOFA

(71) Applicant: Hangzhou China Arts Industrial Co. Ltd., Hangzhou Zhejiang (CN)

(72) Inventors: Ren Li, Hangzhou Zhejiang (CN); Xiaobo Tang, Hangzhou Zhejiang (CN)

(73) Assignee: HANGZHOU CHINA ARTS INDUSTRIAL CO. LTD., Hangzhou Zhejiang (CN)

( * ) Notice: Subject to any disclaimer, the term of this patent is extended or adjusted under 35 U.S.C. 154(b) by 15 days.

(21) Appl. No.: 14/661,447

(22) Filed: Mar. 18, 2015

(65) Prior Publication Data

US 2016/0143445 A1 May 26, 2016

(30) Foreign Application Priority Data

Nov. 26, 2014 (CN) ..... 2014 2 0718435 U

(51) Int. Cl.
*A47C 17/02* (2006.01)
*A47C 4/02* (2006.01)

(52) U.S. Cl.
CPC ..... *A47C 17/02* (2013.01); *A47C 4/021* (2013.01)

(58) Field of Classification Search
CPC ..... A47C 4/02; A47C 4/021
USPC ..... 297/440.1, 440.16, 440.22, 440.23
See application file for complete search history.

(56) References Cited

U.S. PATENT DOCUMENTS

| | | | | |
|---|---|---|---|---|
| 1,251,714 | A * | 1/1918 | Walton | B60N 2/20 297/378.12 |
| 4,919,485 | A * | 4/1990 | Guichon | A47C 4/03 297/440.15 |
| 5,088,180 | A * | 2/1992 | Nottingham | A47C 3/00 29/469 |
| 5,358,309 | A * | 10/1994 | Fedele | A47C 3/00 297/440.1 |
| 5,439,268 | A * | 8/1995 | Dozsa-Farkas | A47C 1/03 248/118.5 |
| 6,241,317 | B1 * | 6/2001 | Wu | A47C 4/02 297/440.1 |
| 8,128,173 | B2 * | 3/2012 | Huang | A47C 4/024 297/440.1 |
| 8,511,753 | B2 * | 8/2013 | Huang | A47C 3/00 297/440.2 |
| 9,066,595 | B2 * | 6/2015 | Kumazawa | A47C 5/10 |
| 2004/0021359 | A1 * | 2/2004 | Chang | A47C 13/005 297/440.23 |

(Continued)

*Primary Examiner* — Timothy J Brindley
(74) *Attorney, Agent, or Firm* — Pearne & Gordon LLP

(57) ABSTRACT

A rapidly assembled sofa includes left and right armrests, a back board and a seat board. The upper portion on the lateral surface of the back board is connected with the armrests in a slider mode, the lower portion on the lateral surface of the back board is connected with the armrests in a latch pin mode, and the seat board is flexibly fastened to the armrests. The rapidly assembled sofa is advantageous in that a connection mode without any bolt is achieved, and the stability in the case of utilizing a bolt for connection can be achieved; the assembling becomes much easier, more convenient and faster, and both time and energy are saved; the assembling operation can be accomplished by a single person, which is especially suitable for women customers; and the contour is clean and artistic since the connection structure is hidden after assembled.

7 Claims, 7 Drawing Sheets

(56) References Cited

U.S. PATENT DOCUMENTS

| | | | | |
|---|---|---|---|---|
| 2005/0179303 | A1* | 8/2005 | Owens | A47C 4/02 297/440.1 |
| 2011/0089739 | A1* | 4/2011 | Huang | A47C 4/02 297/440.23 |
| 2011/0181084 | A1* | 7/2011 | Arnold, IV | A47D 1/002 297/256.16 |
| 2012/0248843 | A1* | 10/2012 | Sinchok | A47C 4/02 297/440.1 |
| 2013/0134763 | A1* | 5/2013 | Koch | A47C 17/02 297/440.23 |
| 2014/0139000 | A1* | 5/2014 | Ogg | A47C 1/124 297/411.2 |
| 2014/0239679 | A1* | 8/2014 | Griggs, Jr. | A47C 1/02 297/183.1 |

* cited by examiner

RAPIDLY ASSEMBLED SOFA

TECHNICAL FIELD

The utility model relates to a kind of furniture, and particularly is a rapidly assembled sofa.

BACKGROUND OF THE INVENTION

A sofa is a daily necessity standing for every family and is commonly used in people's daily life. At present, more and more detachable sofas appear in the market motivated by the transportation cost but can only be installed with the aid of tools because there are too much screws to be connected, resulting in difficulties in installing and wasting both time and energy.

SUMMARY OF THE UTILITY MODEL

The technical problem to be solved by the utility model is to provide a rapidly assembled sofa with a stable structure, which is convenient to install without any bolt. To solve the above technical problem, a rapidly assembled sofa is provided by the utility model. The sofa comprises left and right armrests, a back board and a seat board. The upper portion on the lateral surface of the back board is connected with the armrests in a slider mode, the lower portion on the lateral surface of the back board is connected with the armrests in a latch pin mode, and the seat board is flexibly fastened to the armrests. A connection mode without any bolt is used by the armrests, the back board and the seat board, making the installation convenient, easy and fast.

Preferably, the upper portion on the lateral surface of the back board is provided with a guide groove and a slider sliding along the guide groove is provided on each armrest. The guide groove is functional in guiding and positioning and makes it convenient for assembling the back board and the armrests.

Preferably, the guide groove is provided with a narrow upper portion and a wide lower portion, a slider cap is provided on the slider, the width of the upper portion of the guide groove matches the width of the slider, and the width of the slider cap matches the width of the lower portion of the guide groove and is more than the width of the upper portion of the guide groove. The slider cap can prevent the slider from sliding out of the guide groove and has a role in limiting position.

Preferably, the bottom portion on the lateral surface of the back board is provided with a gap, a door bolt is provided in the gap and is fastened and connected thereto, and a locating-hole used cooperatively with the bolt on the door bolt is provided on each armrest. It is convenient to assemble and fix, and saves both time and energy by connecting in a latch pin mode.

Preferably, two position regulating slots are provided on the door bolt, the bolt is separated from the locating-hole when positioned in the left position regulating slot, and the bolt is inserted into the locating-hole when positioned in the right position regulating slot. The disassembly and installation of the armrests and the back board can be regulated by the two position regulating slots.

Preferably, a support beam for supporting the seat board is provided on a bottom board of each armrest, a limiting block is provided on the support beam, the contact surface of the limiting block and the seat board is an inclined plane, an elastic component for fastening the seat board is provided inside the limiting block, and a limiting hole used cooperatively with the elastic component is provided on the seat board. The connection mode without any bolt makes the assembly much more simple, convenient and fast.

Preferably, the elastic component comprises a clamping cover with an external screw thread, a spring and a locating ball, the spring and the locating ball are both provided in the clamping cover, one end of the spring is connected with the bottom end of the clamping cover, the other end of the spring is connected with the locating ball, an inclined through-hole is provided on the bottom board of each armrest, and the clamping cover is spirally screwed into the inclined through-hole. The seat board and the armrests are pressed against each other through the elastic force of the spring, a connection mode without any bolt is achieved, and the structure is stable.

After the above structure is adopted, the rapidly assembled sofa in the utility model has the following advantages as compared with the sofas in the prior art: a connection mode without any bolt is achieved, and the stability in the case of utilizing a bolt for connection can be achieved; the assembling becomes much easier, more convenient and faster, and both time and energy are saved; the assembling operation can be accomplished by a single person, which is especially suitable for women customers; and the contour is clean and artistic since the connection structure is hidden after assembled.

In which: 1. armrests, 2. back board, 3. seat board, 4. guide groove, 5. slider block, 6. slider cap, 7. gap, 8. door bolt, 8.1. bolt, 8.2. position regulating slot, 9. locating-hole, 10. support beam, 11. limiting block, 12. limiting hole, 13. clamping cover, 14. spring, and 15. locating ball.

DETAILED DESCRIPTION OF THE EMBODIMENTS

The utility model will be further described hereinafter through an embodiment with the accompanying drawings.

Figure 1:
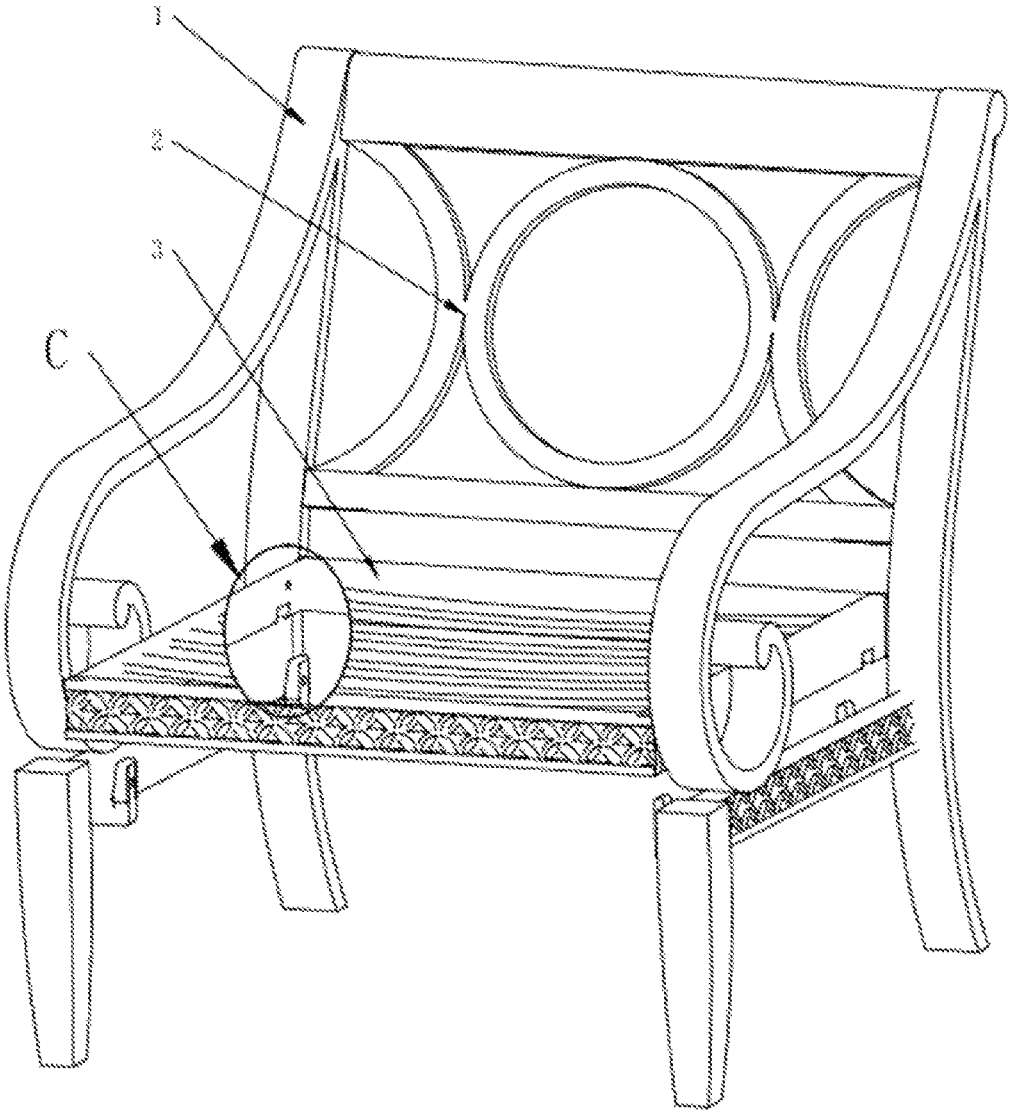
FIG. 1 is a structural schematic view of the utility model.

As shown in FIG. 1, a rapidly assembled sofa is provided by the utility model. The sofa comprises left and right armrests 1, a back board 2 and a seat board 3. The upper portion on the lateral surface of the back board 2 is connected with the armrests 1 in a slider mode, the lower portion on the lateral surface of the back board 2 is connected with the armrests 1 in a latch pin mode, and the seat board 3 is flexibly fastened to the armrests 1.

Figure 4:
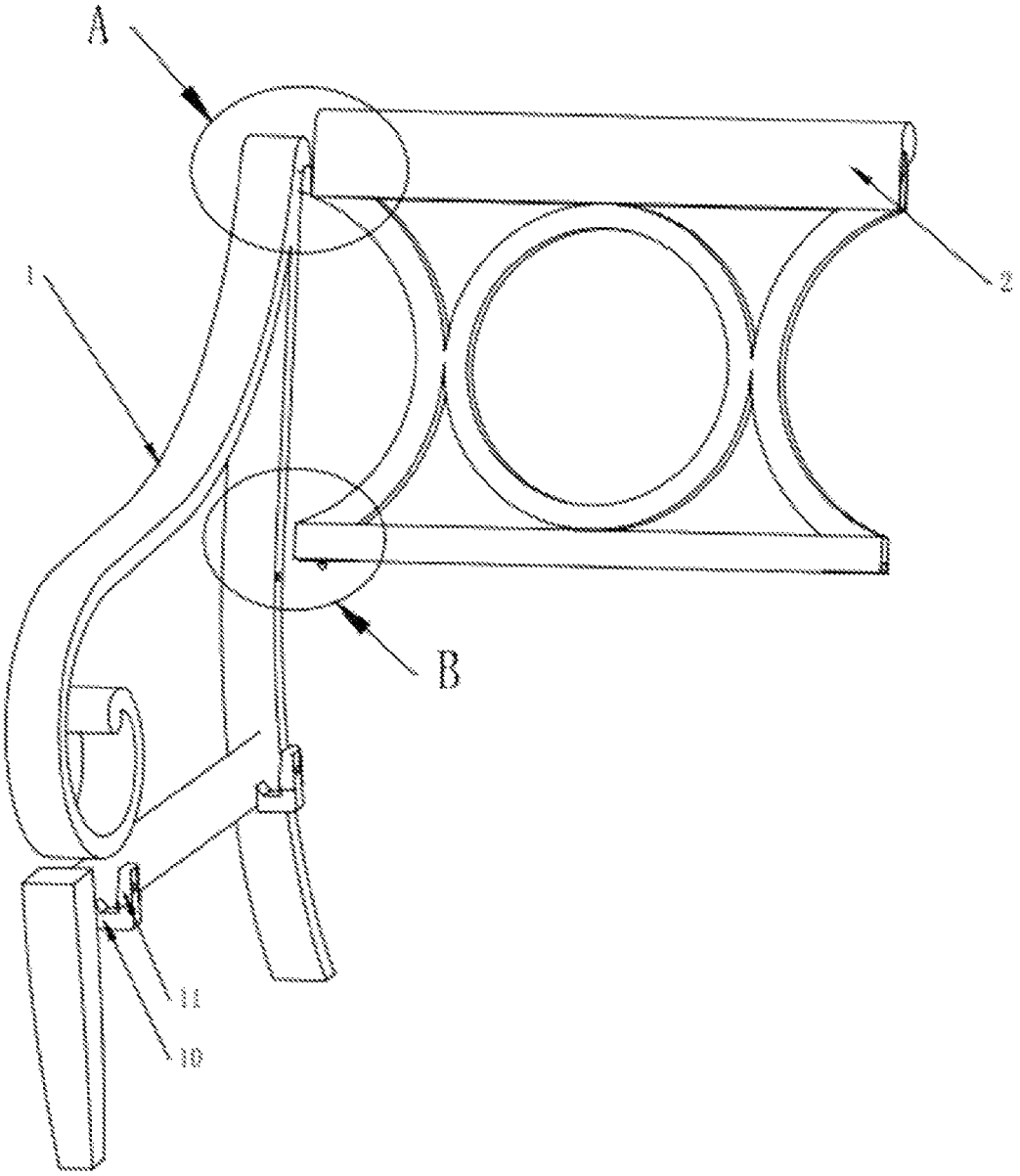
FIG. 4 is a structural schematic view of the armrest and the back board.
Figure 5:
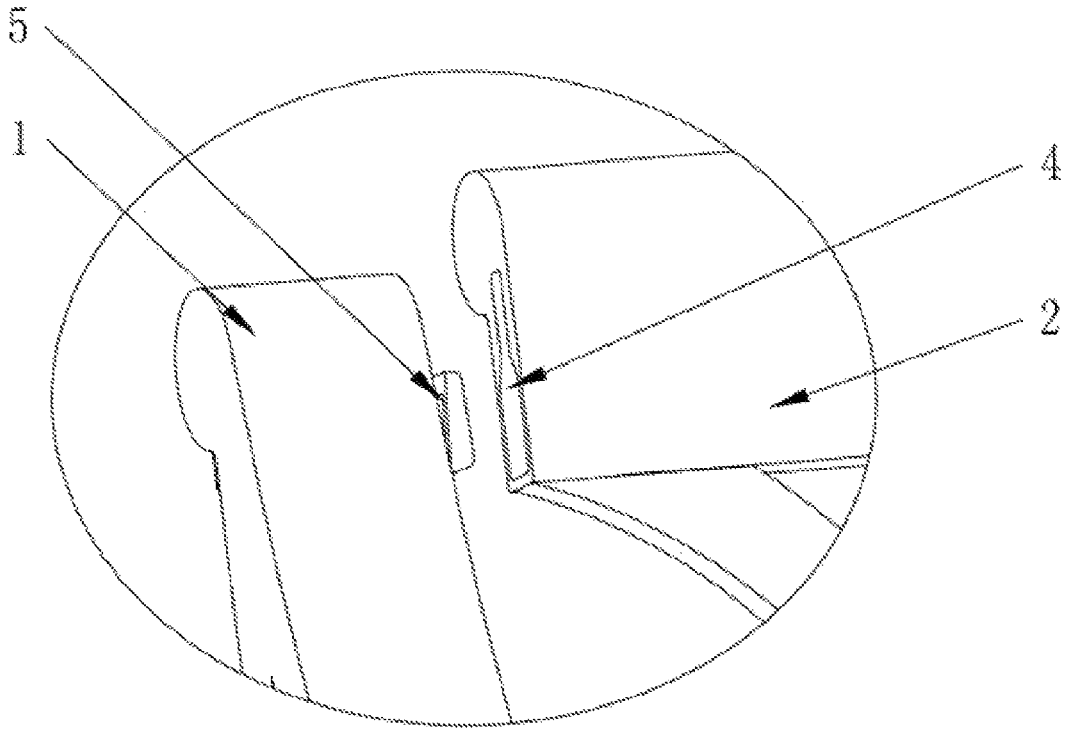
FIG. 5 is a partial enlarged view at A in FIG. 4.
Figure 6:
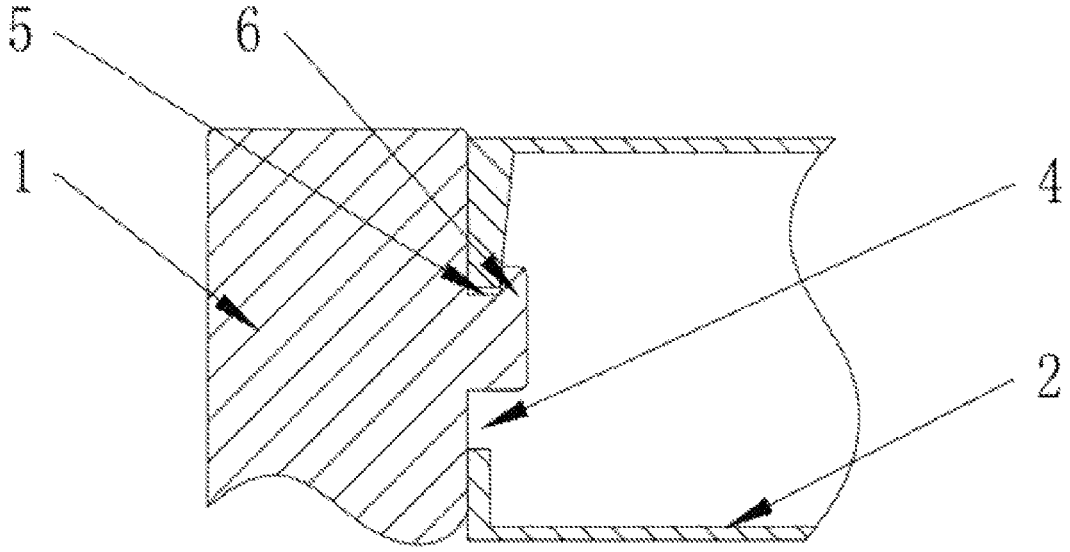
FIG. 6 is a sectional view of the connection between the armrest and the back board.

As shown in FIGS. 4 to 6, the upper portion on the lateral surface of the back board 2 is provided with a guide groove 4 and a slider 5 sliding along the guide groove 4 is provided on each armrest 1. The guide groove 4 is provided with a narrow upper portion and a wide lower portion, a slider cap 6 is provided on the slider 5, the width of the upper portion of the guide groove 4 matches the width of the slider 5, and the width of the slider cap 6 matches the width of the lower portion of the guide groove 4 and is more than the width of the upper portion of the guide groove 4.

Figure 7:
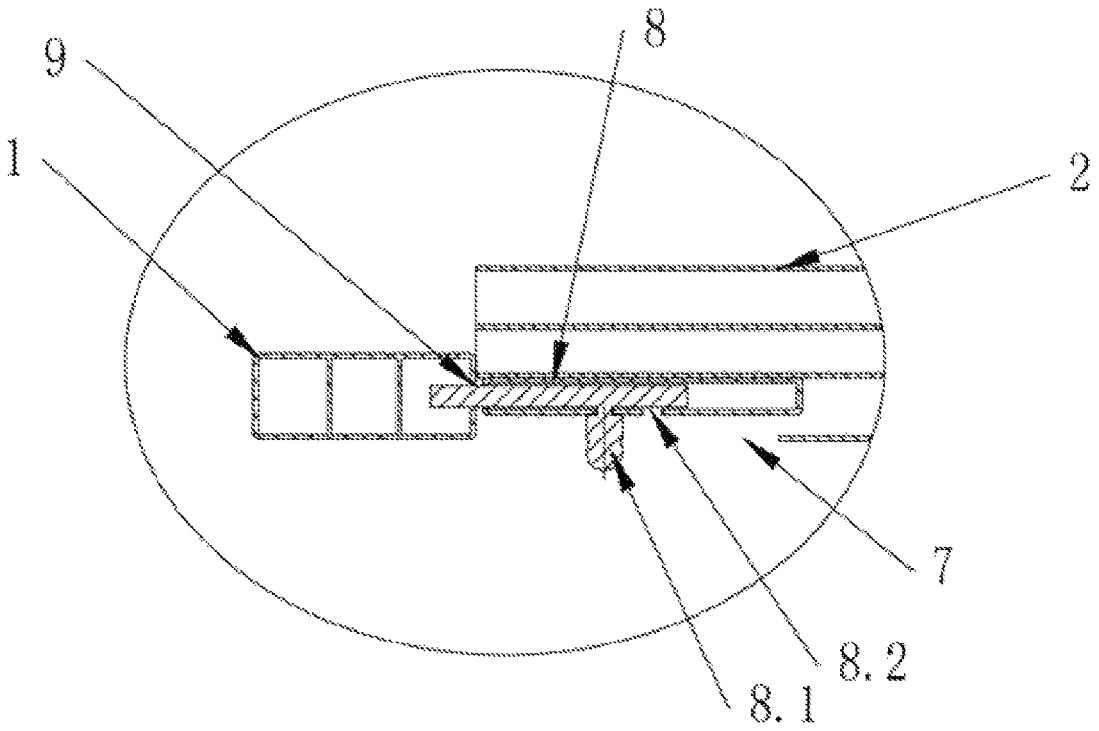
FIG. 7 is a sectional view at B in FIG. 4.

As shown in FIG. 7, the bottom portion on the lateral surface of the back board 2 is provided with a gap 7, a door bolt 8 is provided in the gap 7 and is fastened and connected thereto, and a locating-hole 9 used cooperatively with the bolt 8.1 on the door bolt 8 is provided on each armrest 1. Two position regulating slots 8.2 are provided on the door bolt 8, the bolt 8.1 is separated from the locating-hole 9 when the bolt 8.1 is positioned in the left position regulating slot, and the bolt 8.1 is inserted into the locating-hole 9 when the bolt 8.1 is positioned in the right position regulating slot.

Figure 2:
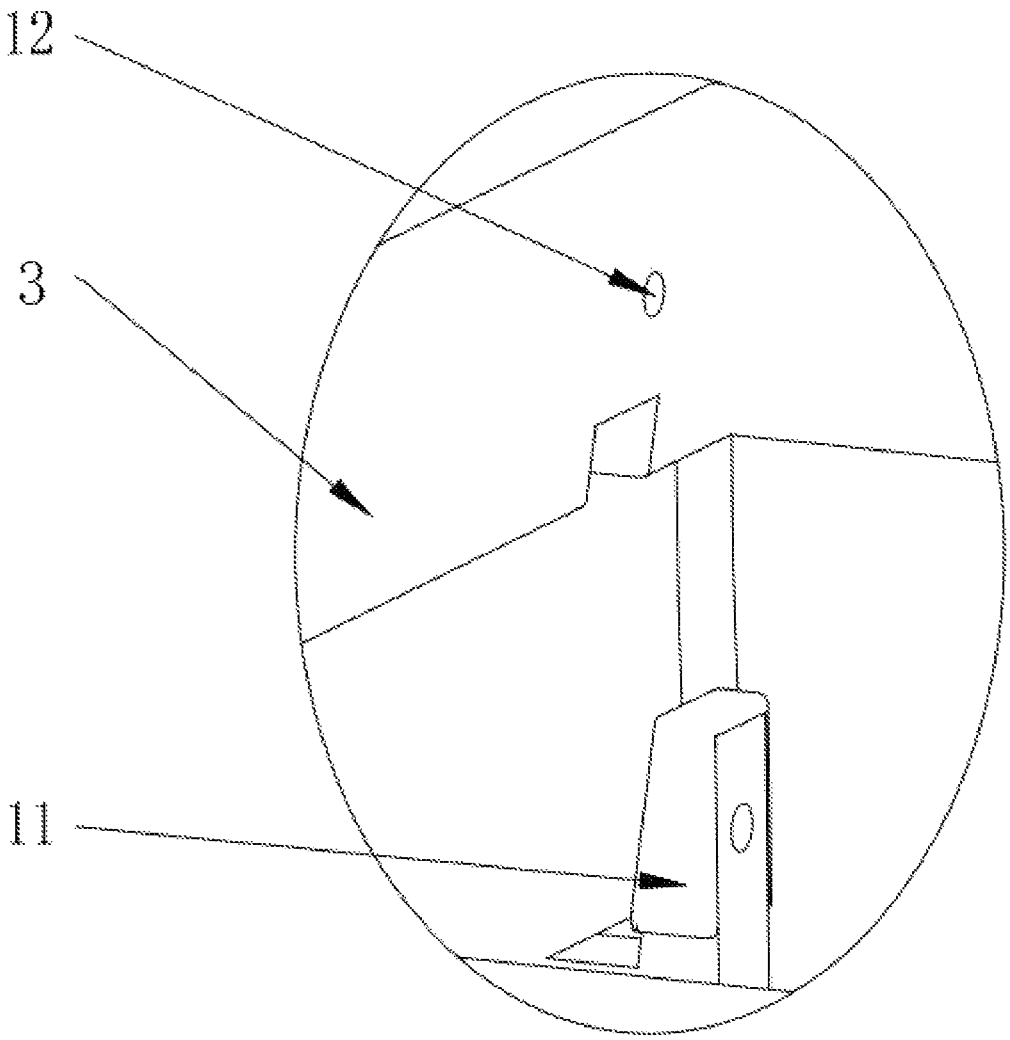
FIG. 2 is a partial enlarged view at C in FIG. 1.
Figure 3:
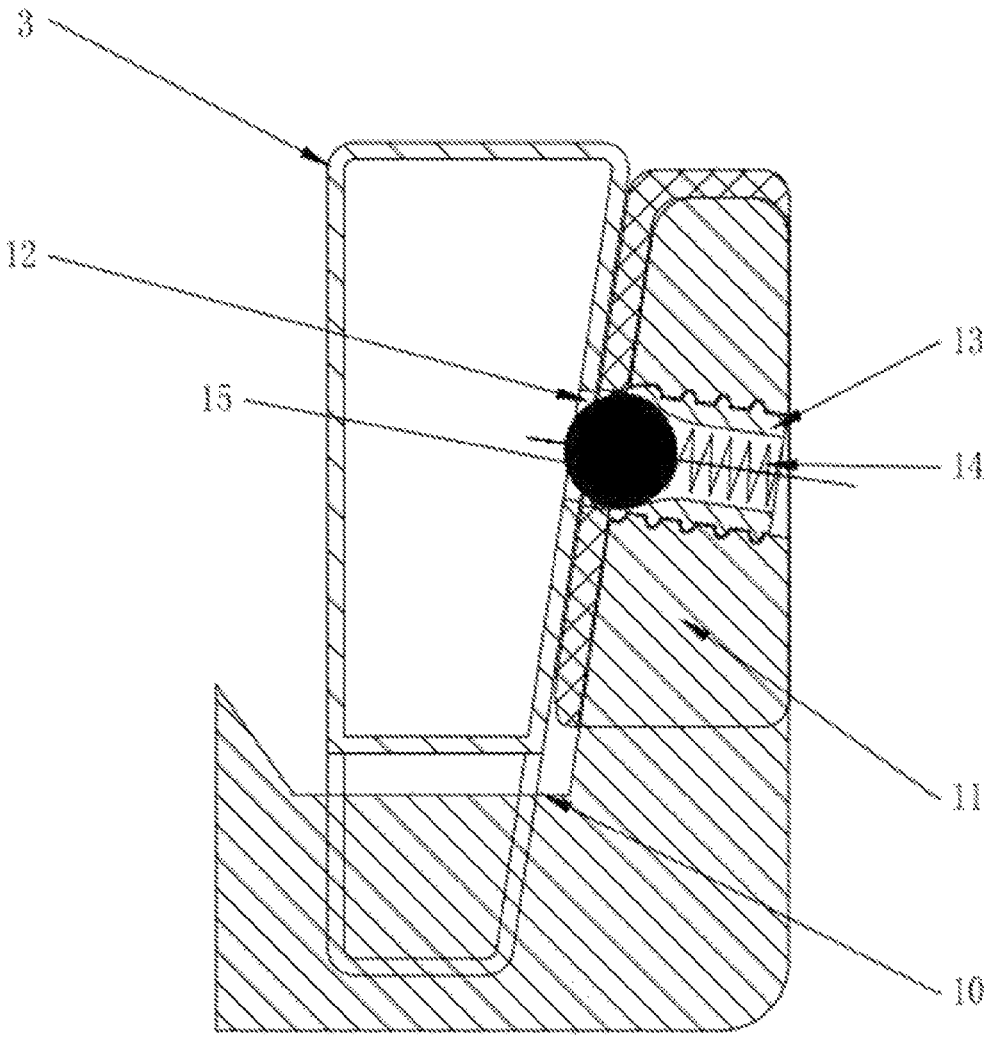
FIG. 3 is a sectional view of the connection between the armrest and the seat board.

As shown in FIGS. 2 and 3, a support beam 10 for supporting the seat board 3 is provided on a bottom board of each armrest 1, a limiting block 11 is provided on the support beam 10, the contact surface of the limiting block 11 and the seat board 3 is an inclined plane, an elastic component for fastening the seat board 3 is provided inside the limiting block 11, and a limiting hole 12 used cooperatively with the elastic component is provided on the seat board 3. The elastic component comprises a clamping cover 13 with an external screw thread, a spring 14 and a locating ball 15, the spring 14 and the locating ball 15 are provided in the clamping cover 13, one end of the spring 14 is connected with the bottom end of the clamping cover 13, the other end of the spring 14 is connected with the locating ball 15, an inclined through-hole is provided on the bottom board of each armrest 1, and the clamping cover 13 is spirally screwed into the inclined through-hole.

First of all, the slider 5 on each armrest 1 matches the guide groove 4 on the back board 2. The bolt 8.1 on the door bolt 8 that is fastened to the back board 2 is inserted into the locating-hole 9 on each armrest to be fastened after the armrests 1 are positioned. Finally, the seat board 3 is placed on the support beam 10 on the armrests 1 and the locating ball 15 is pressed into the locating-hole 12 inside the seat board 3 with the action of the elastic force of the spring 14 to achieve the effect of fastening.

The invention claimed is:

1. A rapidly assembled sofa, which comprises left and right armrests, a back board and a seat board, wherein the upper portion on the lateral surface of the back board is connected with the armrests in a slider mode, the lower portion on the lateral surface of the back board is connected with the armrests in a latch pin mode, and the seat board is fastened to the armrests, wherein to provide the latch pin mode, the bottom portion on the lateral surface of the back board is provided with a gap, a door bolt is provided in the gap and is fastened and connected thereto, and a locating-hole used cooperatively with the bolt on the door bolt is provided on each armrest, and wherein two position regulating slots are provided on the door bolt, the bolt is separated from the locating-hole when positioned in a left position regulating slot, and the bolt is inserted into the locating-hole when positioned in a right position regulating slot.

2. The rapidly assembled sofa of claim 1, wherein to provide the slider mode, the upper portion on the lateral surface of the back board is provided with a guide groove and a slider sliding along the guide groove is provided on each armrest.

3. The rapidly assembled sofa of claim 2, wherein the guide groove is provided with a narrow upper portion and a wide lower portion, a slider cap is provided on the slider, the width of the upper portion of the guide groove matches the width of the slider, and the width of the slider cap matches the width of the lower portion of the guide groove and is larger than the width of the upper portion of the guide groove.

4. A rapidly assembled sofa, which comprises left and right armrests, a back board and a seat board, wherein the upper portion on the lateral surface of the back board is connected with the armrests in a slider mode, the lower portion on the lateral surface of the back board is connected with the armrests in a latch pin mode, and the seat board is flexibly fastened to the armrests, wherein a support beam for supporting the seat board is provided on a bottom board of each armrest, a limiting block is provided on the support beam, the contact surface of the limiting block and the seat board is an inclined plane, an elastic component for fastening the seat board is provided inside the limiting block, and a limiting hole used cooperatively with the elastic component is provided on the seat board.

5. The rapidly assembled sofa of claim 4, wherein the elastic component comprises a clamping cover with an external screw thread, a spring and a locating ball, the spring and the locating ball are both provided in the clamping cover, one end of the spring is connected with the bottom end of the clamping cover, the other end of the spring is connected with the locating ball, an inclined through-hole is provided on the bottom board of each armrest, and the clamping cover is spirally screwed into the inclined through-hole.

6. The rapidly assembled sofa of claim 4, wherein to provide the latch pin mode, the bottom portion on the lateral surface of the back board is provided with a gap, a door bolt is provided in the gap and is fastened and connected thereto, and a locating-hole used cooperatively with the bolt on the door bolt is provided on each armrest.

7. The rapidly assembled sofa of claim 6, wherein two position regulating slots are provided on the door bolt, the bolt is separated from the locating-hole when positioned in a left position regulating slot, and the bolt is inserted into the locating-hole when positioned in a right position regulating slot.

* * * * *